US009359812B2

(12) United States Patent
Lin

(10) Patent No.: US 9,359,812 B2
(45) Date of Patent: Jun. 7, 2016

(54) WINDOW COVERING

(71) Applicant: Whole Space Industries LTD, Taipei (TW)

(72) Inventor: Tzu-Yen Lin, Taipei (TW)

(73) Assignee: Whole Space Indsutries Ltd., Taipei (TW)

( * ) Notice: Subject to any disclaimer, the term of this patent is extended or adjusted under 35 U.S.C. 154(b) by 0 days.

(21) Appl. No.: 14/478,297

(22) Filed: Sep. 5, 2014

(65) Prior Publication Data

US 2016/0069129 A1 Mar. 10, 2016

(51) Int. Cl.

| | |
|---|---|
| ***A47H 5/00*** | (2006.01) |
| ***E06B 9/26*** | (2006.01) |
| *E06B 9/303* | (2006.01) |
| *E06B 9/262* | (2006.01) |
| *E06B 9/24* | (2006.01) |

(52) U.S. Cl.

CPC . *E06B 9/26* (2013.01); *E06B 9/262* (2013.01); *E06B 9/303* (2013.01); *E06B 2009/2423* (2013.01); *E06B 2009/2458* (2013.01)

(58) Field of Classification Search

CPC ..... E06B 9/262; E06B 2009/2622; E06B 2009/2625; E06B 2009/2423; E06B 2009/2447; E06B 2009/2452; E06B 2009/2458

USPC ..... 160/84.03, 84.01, 84.08, 178.1 R, 160/168.1 R

See application file for complete search history.

(56) References Cited

U.S. PATENT DOCUMENTS

| | | | | |
|---|---|---|---|---|
| 2,586,340 | A | 2/1952 | Hyde | |
| 2,678,094 | A | 5/1954 | Sargent | |
| 3,777,800 | A | 12/1973 | Susoev | |
| 4,096,904 | A | 6/1978 | Donofrio | |
| 4,610,292 | A | 9/1986 | Hausmann et al. | |
| 4,909,298 | A | 3/1990 | Langhart et al. | |
| 5,465,779 | A | 11/1995 | Rozon | |
| 5,467,266 | A | 11/1995 | Jacobs et al. | |
| 5,482,105 | A | 1/1996 | Rude | |
| 5,533,559 | A | 7/1996 | Judkins | |
| 5,630,458 | A | 5/1997 | Holden | |
| 6,079,639 | A | 6/2000 | Barbato | |
| 6,402,110 | B1 | 6/2002 | Berman et al. | |
| 6,431,248 | B1 | 8/2002 | Hyman et al. | |
| 6,484,787 | B1 | 11/2002 | Walters | |
| 6,520,238 | B2 * | 2/2003 | Allsopp | E06B 9/262 160/84.04 |
| 6,637,493 | B1 | 10/2003 | Lampers | |

(Continued)

*Primary Examiner* — Katherine Mitchell
*Assistant Examiner* — Johnnie A Shablack
(74) *Attorney, Agent, or Firm* — Buchanan Ingersoll & Rooney PC

(57) ABSTRACT

A window covering includes a liner attached to a first rail and window covering material attached to the first rail and the liner such that the window covering material is moveable from a retracted position to an extended position when the liner is moved from its retracted position to its extended position. The window covering material can be configured to define a first number of folds when the window covering material is moved to the retracted position of the window covering material. The liner can be configured to define a second number of folds when the liner is moved to the retracted position of the liner. The second number of folds can be a number of folds that is at least 50% larger than the first number of folds formed in the window covering material when it is moved to its retracted position.

20 Claims, 7 Drawing Sheets

(56) References Cited

U.S. PATENT DOCUMENTS 6,662,845 B1 * 12/2003 Palmer ..... E06B 9/262 160/330
6,662,846 B1 12/2003 Hanright
6,679,309 B2 1/2004 Hsu
6,749,000 B2 6/2004 Bohlen
6,860,312 B2 3/2005 Judkins
6,918,425 B2 7/2005 Nien
6,923,236 B2 8/2005 Lin
6,948,546 B2 9/2005 Nien
7,000,672 B2 2/2006 Nien
7,086,446 B2 8/2006 Kollman et al.
7,117,917 B2 * 10/2006 Allsopp ..... B32B 5/26 160/84.04
7,117,918 B2 10/2006 Franssen
7,225,850 B2 6/2007 McCarty et al.
7,261,138 B2 8/2007 Judkins et al.
7,318,251 B2 1/2008 Lin
7,353,856 B2 4/2008 Pon et al.
7,654,299 B2 2/2010 LeBlanc et al.
7,849,907 B2 12/2010 Jang
7,950,437 B2 5/2011 Lin
8,079,397 B2 12/2011 Robertson
D651,438 S 1/2012 Lin
8,113,261 B2 2/2012 Lin
8,132,610 B2 3/2012 Lin
D666,043 S 8/2012 Lin
8,261,807 B2 * 9/2012 Dann ..... E06B 9/24 160/121.1
8,261,808 B2 9/2012 Perkowitz
8,267,144 B2 9/2012 Hsu et al.
8,316,911 B2 * 11/2012 Cleaver ..... E06B 9/262 160/168.1 R
D672,179 S 12/2012 Lin
8,376,022 B2 2/2013 Lin
D683,563 S 6/2013 Lin
8,474,507 B2 * 7/2013 Anthony ..... E06B 9/262 160/168.1 R
8,511,363 B2 8/2013 Lin
8,544,522 B2 10/2013 Lin
8,561,665 B2 10/2013 Lin
8,596,327 B2 * 12/2013 Rupel ..... E06B 9/262 160/84.04
8,668,002 B2 * 3/2014 Chen ..... E06B 9/262 160/108
8,684,063 B2 4/2014 Lin
8,695,676 B2 * 4/2014 Lin ..... E06B 9/262 160/108
8,757,237 B2 6/2014 Aoki
8,763,671 B2 7/2014 Vestal
8,905,114 B1 * 12/2014 Whitaker ..... E06B 9/262 160/348
8,950,463 B2 * 2/2015 Vestal ..... E06B 9/262 160/168.1 R
8,967,226 B2 * 3/2015 Vestal ..... E06B 9/262 160/321
9,016,346 B2 * 4/2015 Cha ..... A47H 5/032 160/84.05
2005/0092448 A1 * 5/2005 Lin ..... E06B 9/262 160/290
2006/0144526 A1 7/2006 McGinley
2006/0157204 A1 7/2006 Lin
2007/0023149 A1 2/2007 Lamars et al.
2007/0175593 A1 8/2007 Lin
2007/0175595 A1 8/2007 Lin
2008/0110581 A1 5/2008 Lin
2008/0277074 A1 11/2008 Lin
2008/0295975 A1 12/2008 Lin
2009/0173461 A1 * 7/2009 Liang ..... E06B 9/262 160/368.1
2010/0051209 A1 * 3/2010 Liang ..... E06B 9/262 160/84.04
2010/0186903 A1 * 7/2010 Liang ..... E06B 9/262 160/84.01
2010/0252209 A1 * 10/2010 Wang ..... E06B 9/384 160/84.04
2011/0126990 A1 * 6/2011 Huang ..... E06B 9/262 160/84.01
2011/0209834 A1 * 9/2011 Lowry ..... E06B 9/262 160/84.04
2011/0220301 A1 9/2011 Lin
2011/0247762 A1 10/2011 Lin
2011/0247765 A1 10/2011 Lin
2011/0277943 A1 11/2011 Lin
2011/0308746 A1 * 12/2011 LeBlanc ..... E06B 9/262 160/340
2012/0018108 A1 * 1/2012 Lin ..... E06B 9/262 160/340
2012/0031569 A1 * 2/2012 Elinson ..... E06B 9/262 160/127
2012/0132373 A1 * 5/2012 Lin ..... E06B 9/262 160/84.04
2012/0168094 A1 * 7/2012 Lin ..... E06B 9/262 160/84.04
2012/0193037 A1 * 8/2012 Sengelaub ..... A47H 23/04 160/84.02
2012/0227910 A1 * 9/2012 Lin ..... E06B 9/262 160/84.01
2012/0305199 A1 12/2012 Lin
2013/0048233 A1 2/2013 Lin
2013/0056160 A1 * 3/2013 Dann ..... E06B 9/262 160/84.01
2015/0075726 A1 * 3/2015 Byun ..... E06B 9/262 160/84.04
2015/0218880 A1 * 8/2015 Giest ..... E06B 9/262 160/84.04

* cited by examiner

WINDOW COVERING

FIELD OF THE INVENTION

The present invention relates to window coverings.

BACKGROUND OF THE INVENTION

Window coverings may include a sheet of material that is extendable to a deployed or lowered position and retractable to a raised position, or a stowed position. Examples of window coverings can be appreciated from U.S. Pat. Nos. 3,777,800, 4,610,292, 6,079,639, 6,402,110, 6,662,846, 6,679,309, 6,923,236, 7,353,856, 7,654,299, 7,849,907, 7,950,437, 8,079,397, 8,113,261, 8,132,610, 8,261,808, 8,267,144, 8,511,363, 8,544,522, 8,561,665, 8,684,063, 8,757,237, 8,763,671, D683,563, D672,179, D666,043, D651,438, and U.S. Patent Application Publication Nos. 2006/0157204, 2007/0175593, 2007/0175595, 2008/0277074, 2008/0295975, 2011/0220301, 2011/0247765, 2011/0247762, 2011/0277943, 2012/0305199, and 2013/0048233.

On occasion, children have been able to get behind a lowered window covering and become entangled in one of the lift cords. If the lift cord is around the child's neck and the child falls, the cord could act as a noose and strangle the child. For example, there have been incidents of child entanglements in lift cords of venetian blinds, Roman shades, and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for window coverings are visible from the front of the shade and detract from the aesthetic effect of the shade.

Further, window coverings often fail to permit a user to easily wash window covering material of a window covering. Nor do window coverings permit a user to easily replace window covering material if a new aesthetic effect for the window covering is desired. Instead, consumers typically have to purchase an entirely new window covering, remove their old window covering, and mount their newly bought replacement window covering. This can be costly and time consuming for a consumer.

SUMMARY OF THE INVENTION

A window covering is provided that includes a first rail, a liner attached to the first rail such that the liner is moveable from an extended position to a retracted position, and window covering material attached to at least one of the first rail and the liner such that the window covering material is moveable from an extended position to a retracted position when the liner is moved from the retracted position of the liner to the extended position of the liner. The window covering material can be attached to the liner such that the window covering material forms a first number of folds when the window covering material is moved to the retracted position of the window covering material. The liner can be attached to at least one moveable cord extending from the first rail such that the liner forms a second number of folds when the liner is moved to the retracted position of the liner. The second number of folds can be a number of folds that is at least 50% larger than the first number of folds.

In some embodiments, the second number of folds formed in the liner can be a number of folds that is at least twice as many folds as the first number of folds that are formed in the window covering material during raising of the window covering. In other embodiments, the second number of folds may be between 50% and 100% more folds than the first number of folds.

It should be appreciated that the folds formed in the liner can be transverse folds that fold along the entire width of the liner. The folds formed in the window covering material can also be transverse folds that fold along the entire width of the window covering material. The length of the liner can be the dimension of the liner that extends below the first rail to the bottom of the liner when the liner is in a fully extended position and the length of the window covering material can be the dimension of the window covering material that extends below the first rail to the bottom of the window covering material when the window covering material is in a fully extended position. The width of the liner and the width of the window covering material may extend along the length of the first rail. The width of the first rail may define a depth of the first rail to define a width of a channel defined within the first rail. The height of the first rail can define how tall the first rail is when it is mounted adjacent to a window opening. In some embodiments, the length of the first rail may extend along a width of the window opening when the first rail is mounted adjacent to the window opening. The length of the first rail may also extend along the widths of the liner and the window covering material. In some embodiments, the folds formed in the liner may face toward the window covering material while the folds formed in the window covering material face away from the liner such that the folds are formed to face in the same direction. In other embodiments, the folds formed in the liner may face away form the window covering material while the folds formed in the window covering material face away from the liner such that the folds are formed to face in opposite directions. In some embodiments, the positioning of the rings and spacer cords, if present, can affect the formation of the folds in the liner when the liner is raised while the positioning of the attachment mechanisms for attachment of the window covering material to the liner can define formation of the folds in the window covering material that occur during raising of the window covering.

In some embodiments, a plurality of first stiffening members can be attached to the window covering material at spaced apart locations and a plurality of second stiffening members can be attached to the liner at spaced apart locations. Each of the first stiffening members can be spaced apart from immediately adjacent first stiffening members within the window covering material by a first distance and each of the second stiffening members can be spaced apart from immediately adjacent second stiffening members within the liner by a second distance that is shorter than the first distance. For example, the first distance may be twice as long as the second distance, may be 50% longer than the second distance or may be at least 100% longer than the second distance.

The folds formed in the liner when the liner is moved to the retracted position can be configured to be smaller than the folds formed in the window covering material when the window covering material is moved to the retracted position. For example, the sizing of the folds formed in the liner may be half the size of the folds formed in the window covering material or may be sized so that the folds formed in the window covering material are at least 50% larger than the folds formed in the liner.

Embodiments of the window covering can be configured so that at least one moveable cord attached to the liner is at least one spacer cord. Such embodiments can also be configured to include a first lift cord extending from the first rail to a bottom portion of the liner. The first lift cord can be moveable to move the liner from the retracted position of the liner to the extended position of the liner. Such embodiments can also include a first column of rings that are attached to the liner at spaced apart locations. The first lift cord can pass through the rings of the first column of rings. The rings of the first column of rings can be positioned between the liner and the window covering material. Embodiments of the window covering can also include a second lift cord that is moveable to move the liner from the retracted position of the liner to the extended position of the liner. Such embodiments can also include a second column of rings that are attached to the liner at spaced apart locations so that the second column of rings is parallel to the first column of rings and rings within the first and second columns of rings define rows of rings extending along the width of the liner. The second lift cord can pass through the rings of the second column of rings. The rings of the second column of rings can be positioned between the liner and the window covering material. The rings in each row of rings can be attached to the liner adjacent to a respective one of the stiffening members that may be attached within the liner. In some embodiments, those rings may be attached directly to the stiffening member or may be attached to a loop attached to the liner in a position corresponding to a location at which a portion of the stiffening member is to be positioned within the liner. In some embodiments, the lift cords and rings may be positioned to be between the window covering material and the liner. In other embodiments, the lift cords and rings can be positioned on a rear side of the liner such that the liner is positioned between the rings and the window covering material and the liner is also positioned between the window covering material and the segment of each of the lift cords that extends from the first rail to the bottom portion of the liner.

For instance, embodiments of the window covering that include first and second columns of rings can also include a plurality of first stiffening members attached to the window covering material at spaced apart locations and a plurality of second stiffening members attached to the liner at spaced apart locations. A respective ring of the first column of rings can be attached to the liner at a location adjacent to a respective one of the second stiffening members. In some embodiments, each of the first stiffening members is spaced apart from immediately adjacent first stiffening members within the window covering material by a first distance and each of the second stiffening members is spaced apart from immediately adjacent second stiffening members within the liner by a second distance that is shorter than the first distance.

The rings may be positioned on a front side of the liner so they are between the liner and the window covering material or may be positioned on a rear side of the liner so that the liner is between the rings and the window covering material. The lift cords and/or spacer cords can then extend from the first rail and be routed along the rear or front side of the liner so that the lift cords pass through the rings and the spacer cords are attached to the rings. When the rings are on the rear side of the liner, the liner may be positioned between the window covering material and the rings, lift cords and spacer cords and the folds formed in the liner may face toward the window covering material and the window covering material may cover these folds. When the rings are on the front side of the liner, the liner may form folds on its rear side so that the folds of the liner face away from the window covering material.

In some embodiments of the window covering, the at least one moveable cord is comprised of a first lift cord and the window covering also includes a cord lock attached to the first rail. At least one operator cord can extend from the cord lock to actuate movement of the liner and the window covering material. The window covering material can also have a hole. The operator cord can extend out of the first rail via the cord lock and extend through the hole in the window covering material. The first lift cord can extend from the first rail to a bottom portion of the liner and be attached to the operator cord. For instance, the operator cord can be integral to the first lift cord such that the operator cord is a segment of the first lift cord that extends out of the cord lock to extend out of the first rail. A spacer cord extending from the first rail can also be included in such embodiments. The spacer cord can be connected to the liner and the first cord. Such embodiments can also include a second lift cord that defines a second operator cord that passes through the cord lock and a second spacer cord that extends from the first rail to a bottom portion of the liner and is attached to the second lift cord.

The window covering material can be attached to the first rail via an upper portion of the window covering material that is releasably attachable to the first rail. That releasable attachment mechanism can include: at least one strip of hooks attached to one of the window covering material and the first rail, and at least one strip of loops attached to the other of the window covering material and the first rail. The window covering material can also be attachable to the liner at vertically spaced apart locations via releasable attachment mechanisms positioned at those vertically spaced apart locations. Each of the releasable attachment mechanisms can include: at least one strip of hooks attached to one of the window covering material and the liner, and at least one strip of loops attached to the other of the window covering material and the liner.

A window covering is also provided that includes a headrail, a liner attached to the headrail such that the liner is moveable from an extended position to a retracted position, and window covering material releasably attached to the headrail. The window covering material can also be releasably attachable to the liner at vertically spaced apart locations such that the window covering material is moveable from a retracted position to an extended position when the liner is moved from the retracted position of the liner to the extended position of the liner. A lift system can be attached to the headrail. At least one lift cord can extend from the lift system to a bottom portion of the liner. Movement of the lift cord can drive movement of the liner between the extended position of the liner and the retracted position of the liner. The window covering material can be releasably attached to the liner such that the window covering material forms a first number of folds when the window covering material is moved from the extended position of the window covering material to the retracted position of the window covering material. The liner can be attached to each lift cord such that the liner forms a second number of folds when the liner is moved from the extended position of the liner to the retracted position of the liner. The second number of folds can be a number of folds that is at least 50% larger than the first number of folds.

In some embodiments, the window covering material is releasably attachable to the liner at vertically spaced apart locations via attachment mechanisms that extend along a substantial portion of a width of the liner and a width of the window covering material at those spaced apart locations.

Each of the attachment mechanisms can include at least one strip of hooks attached to one of the window covering material and the liner and at least one strip of loops attached to the other of the window covering material and the liner.

Embodiments of the window covering can include at least two lift cords, such as a first lift cord and a second lift cord. Each of the attachment mechanisms can be configured to define at least a first gap and a second gap along the widths of the liner and the window covering material at the vertically spaced apart locations. The first lift cord can pass through each first gap and the second lift cord can pass through each second gap.

In some embodiments, the window covering material can include a hole defined therein. At least one operator cord attached to first and second lift cords can extend from the headrail passing through the hole of the window covering material for manipulation of the operator cord to actuate the lift system.

Embodiments of the window covering can also include a plurality of first stiffening members attached to the window covering material at spaced apart locations and a plurality of second stiffening members attached to the liner at spaced apart locations. Each of the first stiffening members can be spaced apart from immediately adjacent first stiffening members within the window covering material by a first distance and each of the second stiffening members can be spaced apart from immediately adjacent second stiffening members within the liner by a second distance. The second distance can be smaller than the first distance and there may be more second stiffening members than there are first stiffening members included in the window covering.

Other details, objects, and advantages of the invention will become apparent as the following description of certain present preferred embodiments thereof and certain present preferred methods of practicing the same proceeds.

BRIEF DESCRIPTION OF THE FIGURES

Exemplary embodiments of a window covering and method of using the same are shown in the accompanying drawings. It should be appreciated that like reference numbers used in the drawings may identify like components.

DETAILED DESCRIPTION OF EXEMPLARY EMBODIMENTS

Figure 1:
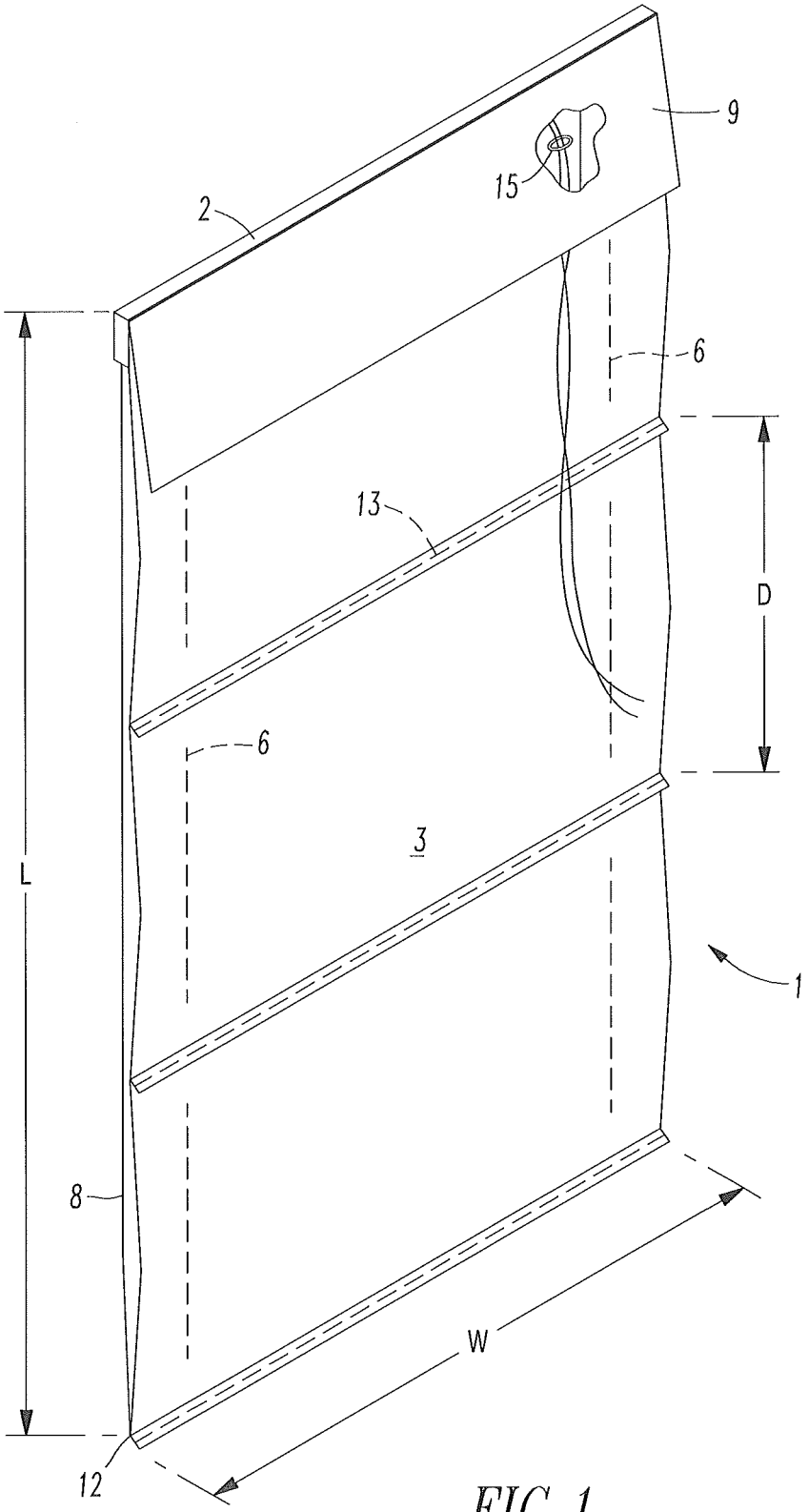
FIG. 1 is a front perspective view of a first exemplary embodiment of my window covering with the window covering material and the liner each in an extended position.
Figure 2:
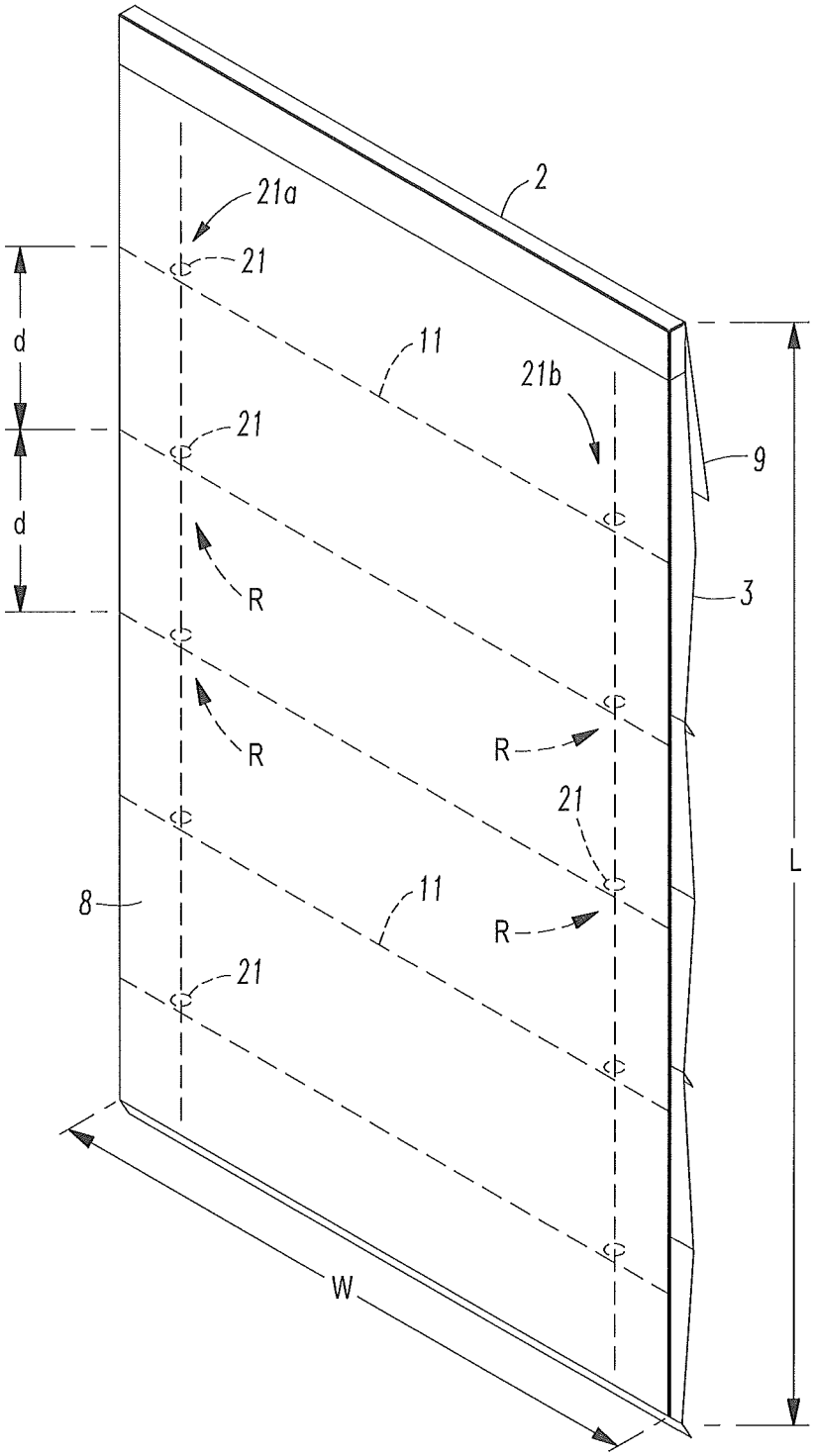
FIG. 2 is a rear perspective view of the first exemplary embodiment of my window covering with the window covering material and the liner each in an extended position.
Figure 3:
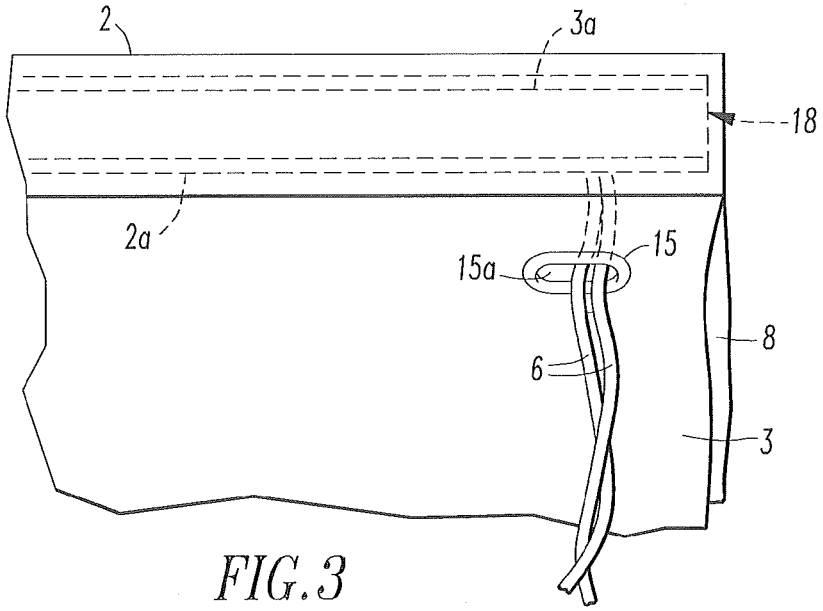
FIG. 3 is a front fragmentary view of the first exemplary embodiment of my window covering with the valance 9 cut away to illustrate a ring element positioned within an upper portion of the window covering material to define a hole therein through which one or more pull cords can pass.
Figure 4:
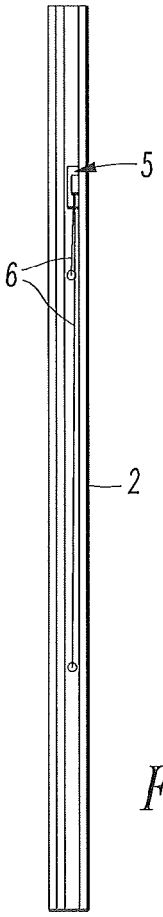
FIG. 4 is a top view of the first exemplary embodiment of my window covering, with the window covering material and the liner each in an extended position.

Referring to FIGS. 1-8, embodiments of my window covering 1 can include a first rail 2. Window covering material 3 and a liner 8 can be attached to the first rail 2 and be moveable from an extended position to a retracted position for raising and lowering the window covering 1. The window covering material 3 and the liner 8 can each have a width W and a length L. In some embodiments, the widths W of the liner 8 and the window covering material 3 can be about the same distance as the length of the elongated first rail 2 (e.g. the same distance or within +/−1-5 cm). The lengths L of the liner and the window covering 3 may be the same distance or may be different distances. The liner 8 and window covering material 3 may extend and retract in a vertical direction along their lengths L when the window covering is mounted adjacent a window opening. In some embodiments, the lengths L of the liner and the window covering material are the linear distances to which the liner and window covering material extend from the first rail 2 to their bottoms when the window covering material and the liner are in their fully extended, or fully lowered, positions.

In some embodiments, the first rail 2 can be configured as a headrail that is configured to be mounted adjacent to a window opening by at least one mounting device (e.g. mounting brackets, fasteners, etc.). In other embodiments, the first rail can be configured as a middle rail of a top-down bottom up shade. For such top down bottom up shades, the middle rail may be moveably connected to a headrail that is to be positioned above the middle rail when the window covering is mounted and can also be connected to a bottom rail that is below the middle rail.

The first rail 2 may have a height and a width. The height of the first rail may define the height of the first rail when it is mounted adjacent a window opening. The height of the first rail may extend perpendicularly from the length of the first rail 2 along which the widths W of the liner and window covering material extend. The width of the first rail may define a depth of the first rail when it is mounted adjacent a window opening and can extend perpendicularly from the length of the first rail 2 in a direction that is also perpendicular to the length of the first rail.

The first rail 2 can include a lift system 5 for control of the raising and lowering of the window covering 1 (e.g. raising of the window covering 1 to move the window covering material 3 and liner 8 into their retracted positions, lowering of the window covering to move the window covering material 3 and liner 8 into their extended positions, or movement of the window covering material 3 and liner 8 to a position them between their fully extended and fully retracted positions). The lift system 5 can be configured as a cord lock. In other embodiments, the lift system 5 can be configured as a loop cord drive, a motor, a spring motor, a roller spring, or other type of lift system that is configured to drive movement of the liner from an extended position of the liner to a retracted position of the liner. Examples of such lift systems that can be utilized in embodiments of the window covering 1 can be appreciated from U.S. Pat. No. 7,950,437 (spring motor), U.S. Pat. Nos. 8,376,022, 6,749,000, 5,482,105 and 5,465,779 (loop cord drive), U.S. Pat. No. 5,467,266 (electric drive motor) and U.S. Pat. Nos. 2,586,340, 2,678,094, 4,096,904, or 4,681,279 (roller spring mechanisms).

Lift cords 6 can be attached to the lift system 5 and be configured to extend out of the first rail 2 to a bottom portion 12 of the liner 8 that is also adjacent to a bottom portion of window covering material 3. The lift system 5 can also include an arrangement of pulleys or spools within the first rail that can define a path of travel along which lift cords can pass while within the first rail. The lift system 5 can alternatively, or in addition, include a rotatable shaft that is rotatable to extend or retract lift cords. In some embodiments, pulleys or spools may be attached to such a shaft to wind and unwind lift cords from about the rotatable shaft.

In some embodiments, proximal ends of each lift cord 6 can be attached to the lift system 5 and distal ends of the lift cords 6 that are opposite the proximal ends can be attached to the bottom portion 12 of the liner 8 when the lift system is configured as a spring motor. A middle portion of the lift cords between the proximal ends of the lift cords attached to the spring motor and the distal ends attached to the bottom portion 12 of the liner 8 may travel over one or more pulleys located within the first rail when the lift cords are moved to raise or lower the window covering 1.

In other embodiments, middle portions of the lift cords can be configured to pass through a cord lock and have terminal ends that extend out of the cord lock and out of the first rail so that the terminal end portions that pass out of the first rail 2 and the cord lock can function as operator cords that are manipulatable by a user to actuate raising and lowering of the window covering. For such embodiments, the operator cords can be integral to the lift cords by being segments of the terminal end portions of the lift cords. Tassels can be connected to these terminal ends. The opposite end portions of the lift cords can be attached to the bottom portion 12 of the liner 8 so that motion of the operator cord portions can result in lowering or raising of the window covering material 3 and liner 8. In yet other embodiments, a single operator cord can be connected to multiple lift cords. The single operator cord can be configured to pass out of the cord lock for extending out of the first rail so that a user can grasp that operator cord to manipulate the cord lock and actuate raising or lowering of the window covering.

For embodiments where one or more operator cords may extend out of a cord lock of a first rail, the window covering material 3 may include an opening 15*a* that is sized and configured so that the one or more operator cords (e.g. segments of lift cords defining the operator cords, a single operator cord attached to multiple lift cords, etc.) can pass out of the first rail 2 and cord lock 5 and also pass through the window covering material 3. The opening 15*a* can be defined by a ring 15 attached to the window covering material 3, which may be a metal ring, a polymeric ring, or other type of structural element that is an annular structure (e.g. an oval shaped annual structure, a rectangular annular structure, etc.). In other embodiments, it is contemplated that the opening 15*a* can be otherwise defined in the window covering material (e.g. a hole defined in the material when that material is formed).

In some embodiments, a valence 9 can also extend from the first rail 2 and cover an upper portion of the window covering material 3. The opening 15*a* can be positioned in the upper portion of the window covering material 3 that is covered by the valence 9 so that the valence 9 can hide the opening 15*a* from view. The one or more operator cords passing out of the first rail 2 and cord lock can extend out of the opening 15*a* along the front of the window covering material 3 to a position below the valence 9 so that those operator cords are visible to a user and are easily grasped by a user for control of the window covering 1.

The lift cords 6 of the window covering may be cords, elongated polymeric filaments, tape, or other elongated flexible members that can extend into and out of a rail for controlling motion of a window covering. In some embodiments, each of the lift cords that extend out of the first rail to the bottom portion of the liner may be different segments of the same cord element that move out of the first rail 2 to extend the window covering material 3 and the liner 8 and move into the first rail to retract the window covering material 3 and the liner 8. For instance, a middle portion of a single lift cord can be attached to a spring motor within the headrail or an operator cord that is sized to pass through a cord lock. A first end segment may extend out of the first rail 2 to the bottom portion 12 of the liner 8 and a second end segment may extend out of the first rail 2 to the bottom portion 12 of the liner 8 along a separate path than the first end segment. The middle portion to which the spring motor or operator cord is connected may be located between the first and second end segments.

Rings 21 can be attached to the liner 8 and be positioned between the liner 8 and the window covering material 3. Each of the rings 21 can be a metal ring, a ring composed of a composite material, a polymeric ring, or other type of structural element that is an annular structure (e.g. an oval shaped annual structure, a rectangular annular structure, etc.). The rings 21 can be positioned in multiple different columns of rings. For each column of rings, a plurality of rings can be attached to the liner in alignment along a length L of the liner at spaced apart locations. Immediately adjacent rings within a column of rings can be spaced apart from each other by a distance d along the length L of the liner 8. Each of the lift cords 6 can pass through a space defined between the liner 8 and the window covering material 3 and can pass through each of the rings 21 of a respective column of rings. For instance, a first lift cord can pass through all the first rings of a first column 21*a* of aligned first rings adjacent a first side of the window covering and a second lift cord can pass through all the aligned second rings of a second column 21*b* of second rings positioned adjacent to a second side of the window covering that is opposite the first side of the window covering.

The columns of rings can be configured to be parallel to each other such that the rings in the parallel columns of rings define rows of rings R. Each row R of rings can be rings that are aligned with each other horizontally along the width W of the liner 8. For example, each row R of rings can be spaced apart from each other along a portion of the width W of the liner 8.

The liner 8 may have a plurality of stiffening members 11 positioned therein. The stiffening members 11 may be positioned within pockets formed in the liner. Each of the stiffening members may be elongated members that are an elongated bar or rod, a ballast member, or other type of elongated member that extends horizontally along the width W of the liner 8. The stiffening members 11 may be spaced apart from each other. For instance, each stiffening member 11 may be spaced apart from immediately adjacent other stiffening members 11 by a distance d along the length L of the liner. The stiffening members 11 can provide weight and/or stiffness to the liner to help facilitate the formation of folds 4*a* when the liner is moved from its extended position to its retracted position. The folds 4*a* may be transverse folds that fold along the entire width of the liner at different spaced apart locations.

All the rings 21 in a respective row R of rings 21 may be attached to different portions of the liner 8 adjacent to a respective one of the stiffening members 11 so that all the rings in a row R of rings are attached to the liner adjacent to the same stiffening member 11. Different rows R of rings 21 can be attached to the liner adjacent to different stiffening members 11 so that each row of rings 21 is attached to the liner adjacent to a respective one of the stiffening members 11. The distance between rings 21 in each respective column to immediately adjacent rings 21 of that column may be the distance d due to the attachment of the rings 21 to the liner in locations adjacent to the stiffening members 11. In some embodiments, the rings 21 may be attached to the stiffening members 11 or may be positioned within loops sewn to the liner at locations that correspond to locations at which the stiffening members 11 are to be positioned within the liner 8.

The window covering material 3 can also include stiffening members 13. The stiffening members 13 may be positioned within tabs formed in the window covering material or may be positioned within pockets or other portions of the window covering material 3. Each of the stiffening members 13 may be a ballast member or other type of elongated member (e.g. an elongated bar or rod or other type of elongated member) that extends horizontally along the width W of the window covering material 3. Each of the stiffening members 13 may be positioned entirely within the window covering material 3 so that it is spaced apart from immediately adjacent other stiffening members 13. For instance, each stiffening member 13 may be positioned to be a distance D along the length L of the window covering material 3 away from immediately adjacent stiffening members 13. The distance D may be a distance that is at least 50% larger than the distance d at which the stiffening members 11 within the liner 8 are spaced apart from each other (e.g. distance D may be at least 1.5×distance d, or may be twice as long as distance d or may be more than twice as long as distance d).

The window covering material 3 may be releasably attached to the first rail 2. For instance, a top portion of the window covering can be releasably attached to the first rail via a releasable attachment mechanism 18. An example of such a releasable attachment mechanism can include releasably interlockable strips of hook and loop fasteners such as Velcro® brand hook and loop fastener strips that can be obtained from Velcro Industries B.V. For example, at least one first strip 2*a* of hooks or loops can be attached the first rail 2 and at least one second strip 3*a* of the other of the hooks or loops can be attached to the top portion of the window covering material 3 so that the two strips can be contacted to each other to releasably attach the top portion of the window covering material 3 to the first rail.

The window covering material 3 can also be releasably attached to the liner at different vertically spaced apart locations by releasable attachment mechanisms 19 so that retraction or extension of the liner 8 also results in the window covering material 3 being retracted or extended at the same time as the liner 8 via motion of the liner 8. Each releasable attachment mechanism 19 can include at least one first strip 19*a* that extends along the width W of the liner 8 and at least one second strip 19*b* of material that extends along the width W of the window covering material 3 so that each second strip 19*b* can be contacted with the first strip 19*a* attached to the liner for releasable attachment to the first strip 19*a* to engage that strip and provide a releasable attachment between the liner 8 and the window covering material 3 along a substantial portion of the widths W of the liner 8 and window covering material 3 along which the first and second strips 19*a*, 19*b* extend.

Figure 5:
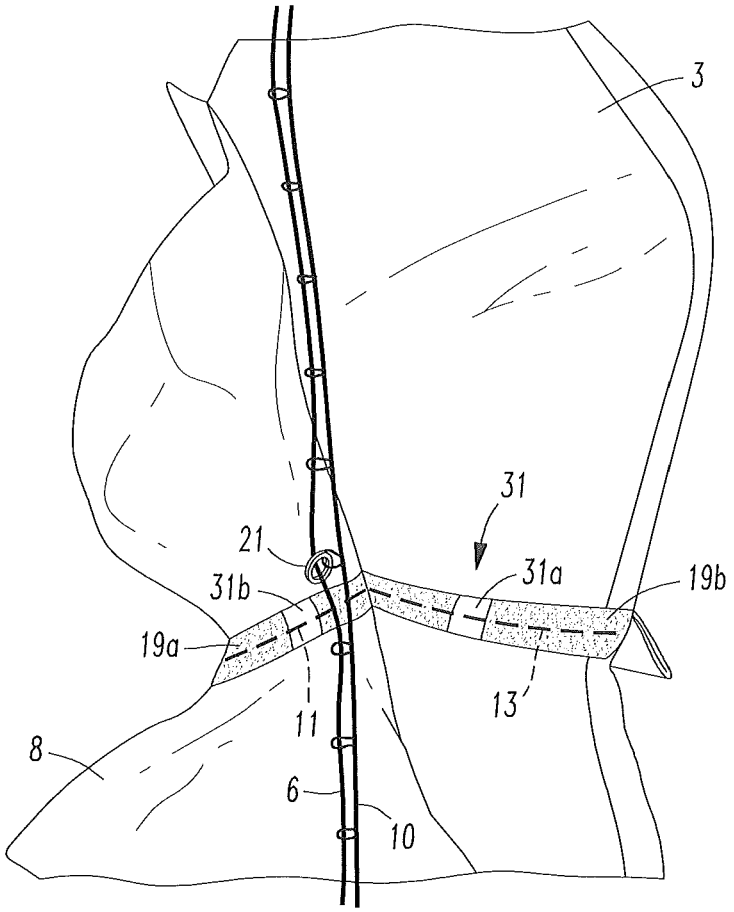
FIG. 5 is a fragmentary side perspective view of the first exemplary embodiment of my window covering with the window covering material and the liner each in a retracted position. A portion of the front window covering material is releasably disconnected from a portion of the liner in FIG. 5 to illustrate a releasable attachment mechanism for attaching discrete spaced apart portions of the front window covering material to the liner.

As indicated by arrow C in FIG. 5, a user can also provide a force to the liner 8 or window covering material 3 to pull the first strip 19*a* away from the second strip 19*b* to separate the first and second strips 19*a*, 19*b* from each other to release the first strip from the second strips for providing a releasable attachment. A user can also subsequently position the first strip 19*a* into contact with the second strip 19*b* to again have the first and second strips engage each other for attachment of the first and second strips together. Releasing the first and second strips 19*a* and 19*b* can permit the window covering material 3 to be separated from the liner 8 and the subsequent contacting of the first and second strips together can allow the window covering material to be attached to the liner 8.

An example of a releasable attachment mechanisms 19 can include releasably interlockable strips of hook and loop fasteners such as Velcro® brand hook and loop fastener strips that can be obtained from Velcro Industries B.V. For example, at least one first strip 19*a* of hooks or loops can be attached the liner 8 and at least one second strip 19*b* of the other of the hooks or loops can be attached to the window covering material 3 so that the first and second strips 19*a* and 19*b* can be contacted to each other to releasably attach the liner 8 to the window covering material 3 along the widths of the liner 8 and window covering material 3 at different vertically spaced apart locations.

Each first strip 19*a* can extend along a portion of the width W of the liner. The first strips 19*a* may be configured so that there is at least two spaced apart gaps 31*b* defined between the hook or loop fasteners within a unitary first strip 19*a* that may extend along a delimited portion of the width W of the liner to help define channels 31 through which lift cords can pass even when the liner 8 and window covering material 3 are attached together via that attachment mechanism 19. In other embodiments in which more than one first strip 19*a* may extend along the substantial portion of the width W of the liner 8, the first strips 19*a* may be spaced apart from each other so that there are gaps 31*b* in which hooks or loops are not positioned between those first strips 19*a* that extend along the width W of the liner in alignment with each other along the width W of the liner 8 at a particular horizontally extending location. The gaps 31*b* can be positioned to correspond to gaps 31*a* formed in the second strip 19*b* or gaps 31*a* defined by aligned but spaced apart separate second strips 19*b* that are positioned on the window covering material 3 to extend along the width W of the window covering material 3. The gaps 31*a* and 31*b* may be positioned to correspond to each other so that when the liner 9 and window covering material 3 are attached together along the width W of the liner 8 and window covering material 3 via the attachment mechanism of the first and second strips 19*a* and 19*b*, they define channels 31 that extend along portions of the lengths L of the window covering material 3 and liner 8 through which lift cords 6 are passable between the liner 8 and window covering material 3 when they are attached together at the spaced apart locations along their widths via the releasable attachment mechanisms 19. Spacer cords 10 that may extend from the first rail 2 to the bottom portion 12 of the liner 8 adjacent to respective lift cords 6 can also extend through such channels 31 defined by the corresponding gaps 31*a* and 31*b*.

The releasable attachment mechanisms 19 that attach the liner 8 to the window covering material 3 at spaced apart locations can be positioned so that each releasable attachment mechanism 19 extends along the widths W of the liner 8 and window covering material 3 horizontally in positions that correspond to the positions of the stiffening members 11 and 13 within the liner 8 and window covering material 3. For example, at least one second strip 19*b* can extend along the width W of the window covering material 3 at a position that corresponds to a location of a respective stiffening member 13 within a tab of the window covering material 3 or otherwise within the window covering material 3. Each second strip 19*b* can be attached to the window covering material 3 at a position that corresponds with a respective one of the stiffening members 13 of the window covering material and may extend along the width W of the window covering material 3 in a direction that corresponds to a direction in which the stiffening member 13 extends horizontally along the width W of the window covering material 3. There may be at least one second strip 19*b* attached to the window covering material adjacent to each and every one of the stiffening members 13 within the window covering material 3. The spacing between immediately adjacent second strips 19*b* attached to the window covering material may be a distance equal to distance D or equivalent to distance D (e.g. equal to or within +/−5% of distance D or +/−10% of distance D).

Each first strip 19*a* can be positioned to extend along the width W of the liner 8 in a position that corresponds with a respective stiffening member 11 that is within the liner 8 and is positioned for releasable attachment to a respective one of the second strips 19*b* attached to the window covering material 3. The first strips 19*a* can be positioned so at least some locations corresponding to the position of some of the stiffening members 11 do not have at least one first strip 19*a* attached thereto as there may be more spaced apart stiffening members 11 in the liner 8 than there are in the window covering material 3. Instead, the first strips 19*a* can be positioned on the liner 8 so that there are first strips 19*a* positioned along and/or adjacent stiffening members 11 so that first strips 19*a* attached to the liner 8 at different spaced apart locations along the length L of the liner 8 so that the spacing between the immediately adjacent first strips 19*a* attached to the liner 8 is a distance equivalent (e.g. equal to or within +/−5% of or +/−10% of) to the distance D that spaces apart immediately adjacent stiffening members 13 within the window covering material.

Figure 6:
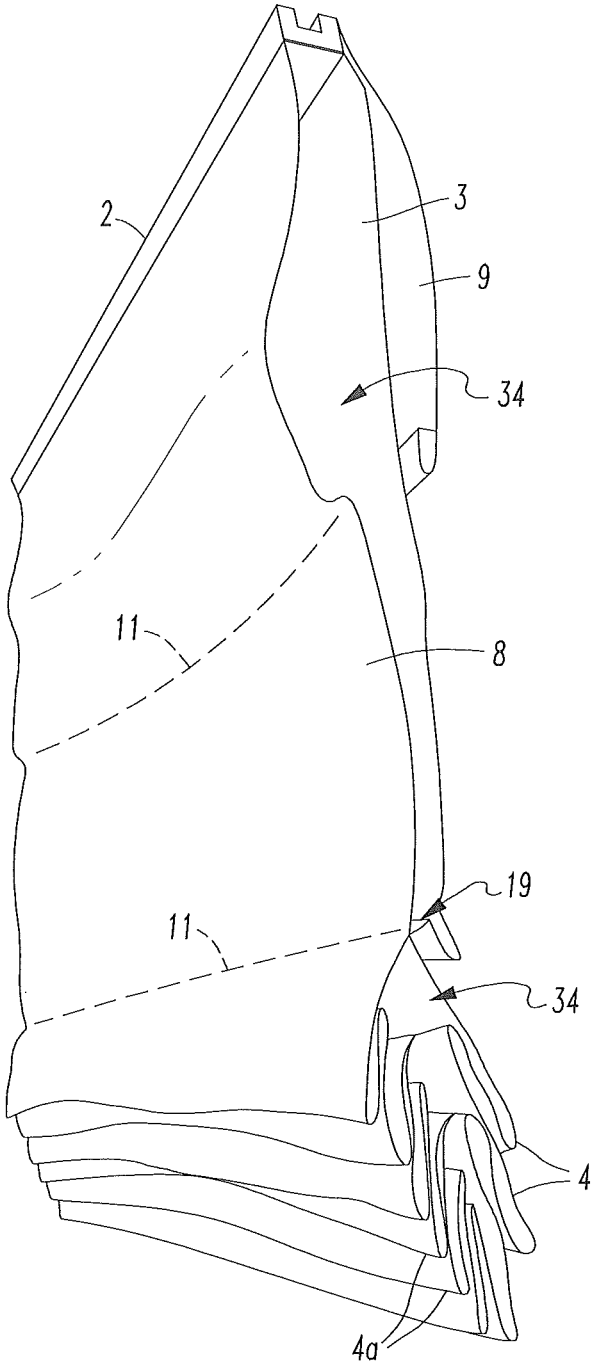
FIG. 6 is a side perspective view of the first exemplary embodiment of my window covering with the window covering material and the liner each in a retracted position. The folds formed in the liner face away from the window covering material and the folds formed in the window covering material face away from the liner.
Figure 7:
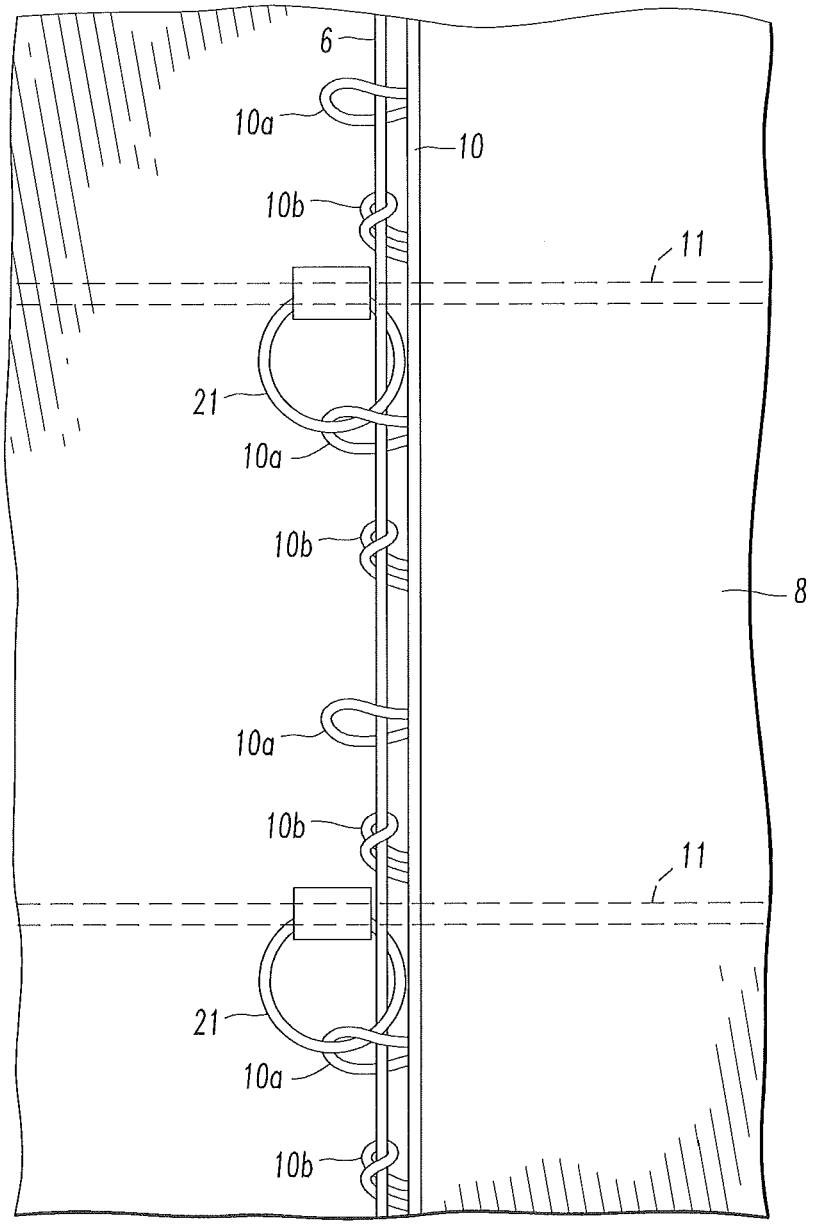
FIG. 7 is a fragmentary view the first exemplary embodiment of my window covering with the window covering material removed to illustrate a lift cord 6 passing through rings 21 of a vertical column of rings 21 attached to the liner 8 and a spacer cord 10 attached to the liner 8 via loops 10*a* extending from the spacer cord to respective rings, and attached to the lift cord 6 via hitches 10*b* and loops 10*a* extending from the spacer cord 10.

The positioning of the stiffening members 13 and attachment mechanisms 19 that releasably attach the liner 8 to the window covering material 3 can help define the size of transverse folds 4 that are formed in the window covering material 3 when the window covering is raised. Those folds 4 may be, for example, 1.5 times, 2 times, or more than 2 times larger than folds 4*a* formed in the liner 8 when the liner 8 is retracted during a raising of the window covering 1 that also results in retracting the window covering material 3 to from folds 4 due to the window covering material's attachment to the liner 8 via the spaced apart releasable attachment mechanisms 19. The folds 4 formed in the window covering material may be transverse folds that are formed along the entire width W of the window covering material at different spaced apart locations. The folds 4 that are formed in the window covering 3 via raising of the liner 8 may face away from the liner 8 as shown in FIG. 6. The folds 4*a* that are formed in the liner during raising of the liner can be defined by the rings 21, spacer cords 10 and lift cords 6 such that the folds 4*a* face away from the window covering material 3 as shown in FIG. 6 such that the folds 4*a* and folds 4 face in opposite directions.

The liner 8 and window covering material 3 can define multiple horizontally extending channels 34 that extend along the widths W of the window covering material 3 and liner 8 when the releasable attachment mechanisms 19 that extend along the widths W of the liner 8 and window covering material 3 attach the liner 8 and window covering material 3 together. These spaced apart channels 34 can be defined by the distances that extend between immediately adjacent second strips 19*b* and the distances between immediately adjacent first strips 19*a* of releasably attachment mechanism (e.g. distances that are equivalent to distance D). The distance at which these defined channels 34 extend along the lengths L of the liner 8 and window covering material 3 can correspond to the size of the folds 4 formed in the window covering material 3 when the window covering material 3 is moved to a retracted position.

In some embodiments the distance D between immediately adjacent stiffening members 13, immediately adjacent first strips 19*a*, and immediately adjacent second strips 19*b* is at least 50% longer than the distance d between immediately adjacent stiffening members 11 and the distance d between immediately adjacent rings 21 in each column of rings attached to the liner 8 so that folds 4 formed in the window covering material 3 when it is raised are at least 50% larger than the folds 4*a* formed in the liner 8. In other embodiments, the distance D between stiffening members 13, immediately adjacent first strips 19*a* and immediately adjacent second strips 19*b* can be at least twice as long as the distance d between immediately adjacent stiffening members 11 so that folds 4 formed in the window covering material 3 when the window covering material 3 is moved from its extended position to its retracted position are twice as large as the folds 4*a* formed in the liner 8 when the liner 8 is moved from its extended position to its retracted position.

Spacer cords 10 can extend from the first rail 2 to the bottom portion 12 of the liner 8. Each spacer cord 10 can extend from the first rail 2 adjacent to a respective one of the lift cords 6 that extend from the first rail 2 to the bottom portion 12 of the liner 8. Each spacer cord 10 can include loops 10*a* and hitches 10*b* that extend from the spacer cord to the lift cord. Some of the loops 10*a* can also extend from the spacer cord 10 to rings 21 within a column of rings through which the lift cord adjacent to that spacer cord passes through for attachment of the spacer cord 10 to the rings 21 and liner 8 via the spacer cord attachment to the rings 21. In some embodiments, the attachment of the spacer cords 10 to the rings 21 can be configured to help facilitate formation of folds 4*a* in the liner 8 when the window covering is raised by periodically attaching the spacer cord 10 to the liner 8 at locations that are vertically spaced apart from other immediately adjacent locations by the distance d separating the immediately adjacent rings 21 in a column of rings 21.

The attachment of the spacer cord 10 to the successive rings 21 as well as the lift cord and the spacing of the rings 21 can help prevent the lift cord 6 from being pulled sufficiently far from the window covering material to form a loop that is large enough to be a strangulation hazard to a child. In some embodiments, the spacing between immediately adjacent rings of a vertical column of rings can be between five and fifteen centimeters or between ten and twenty centimeters. The loops 10*a* may be replaced with hitches 10*b* such that hitches 10*b* also extend from the spacer cord for encircling the rings 21 in some embodiments of the window covering 1.

Each of the hitches 10*b* may be loose hitch knots that permit the lift cord 6 that the hitch 10*b* encircles to easily pass through the hitch 10*b* when the window covering is raised and lowered. However, if the lift cord is pulled in a horizontal direction away from the window covering material the hitch engages the lift cord and grips the lift cord to prevent the lift cord from separating from the spacer cord. Therefore, the length of the spacer cord and the spacing of the rings 21 attached to the liner 8 can define the size of any loop that can be formed by the lift cord 6.

Typically, a small child would not have the dexterity necessary to separate the lift cord from the spacer cord for purposes of pulling the lift cord away from the window covering material to form a noose or loop that may be a strangulation threat to the child. However, it is conceivable that a small child could pull on only a lift cord either by accident or on purpose. Should that occur, the use of hitches 10*b* can prevent separation of the lift cord 6 from the spacer cord 10 as the hitches 10*b* tighten to engage the lift cord 6 and prevent the lift cord 6 from moving horizontally away from the spacer cord to form a loop capable of posing a strangulation hazard to a child. It should be appreciated that while the hitches 10*b* tighten upon horizontal movement of the lift cord away from the spacer cord, the hitches may not tighten about the lift cord as it moves vertically when the window covering is raised or lowered.

Figure 8:
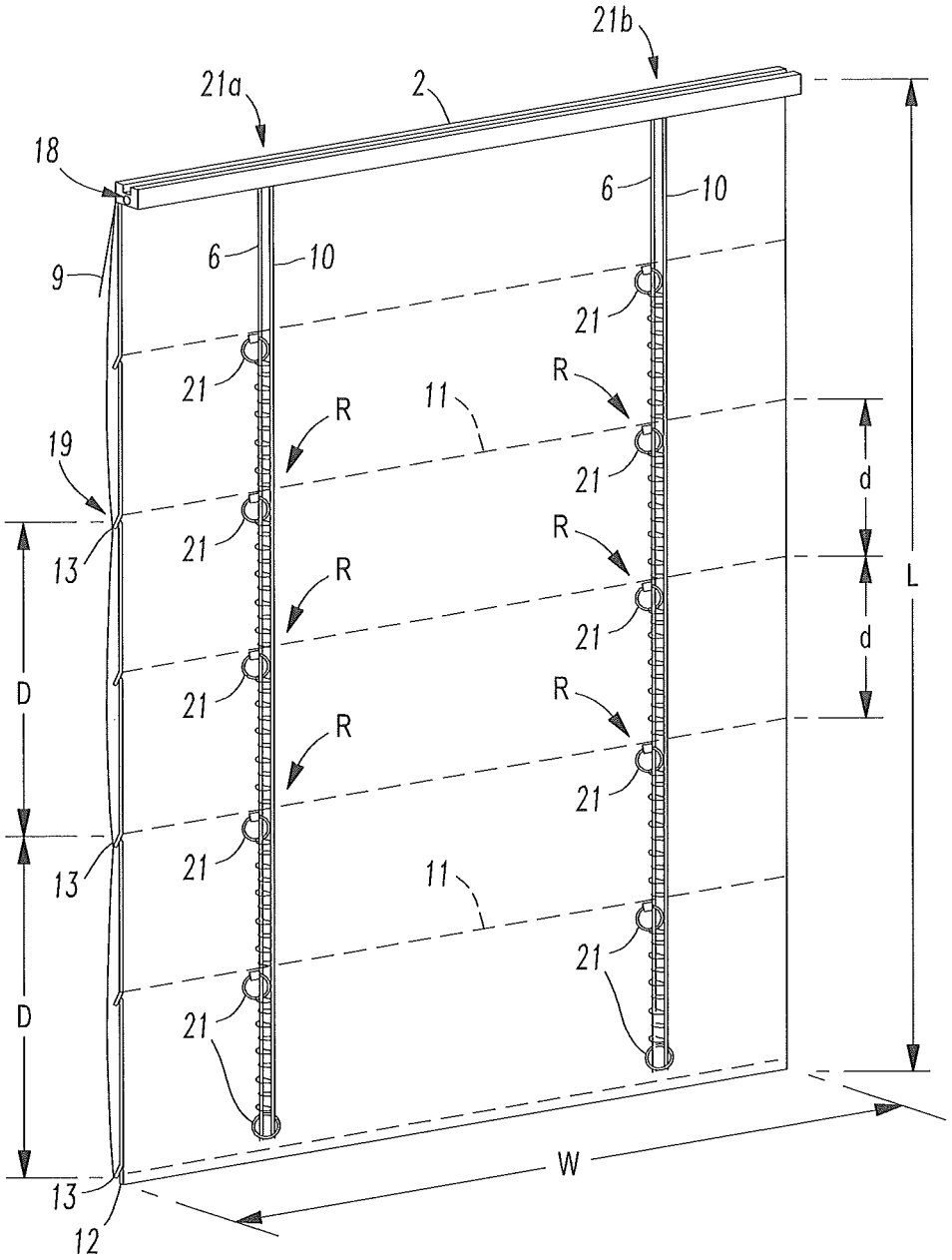
FIG. 8 *s* is a rear perspective view of a second exemplary embodiment of the window covering with the lift cords 6 and spacer cords 10 being attached to a rear side of the liner 8 such that the liner is between the front window covering material 3 and the lift cords 6 and is also between the window covering material 3 and the spacer cords 10. The folds formed in the liner during raising of the liner in the second exemplary embodiment can be configured to face in the same direction as the folds formed in the window covering material during raising of the window covering.

In some embodiments, the lift cords 6, spacer cords 10, and rings 21 may be positioned on a rear side of the liner as shown in FIG. 8 instead of the front side of the liner so that the liner 8 is positioned between the window covering material 3 and the (i) rings 21, (ii) spacer cords 10 and (iii) segments of the lift cords 6 that extend from the first rail 2 to the bottom portion of the liner 8. For the embodiment of FIG. 8, the rings 21 in a column of rings may be spaced apart by a distance d from rings that are immediately adjacent to those rings within the column of rings and the liner 8 may have stiffening members 11 positioned therein so that they are each spaced apart from other immediately adjacent stiffening members along the length L of the liner 8 by distance d. The rings 21 for the embodiment of FIG. 8 may be attached to the spacer cord 10 as in the first embodiment shown in FIGS. 1-7 and discussed herein.

The front window covering material may have stiffening members 13 that are spaced apart from each other along the length L of the window covering material by distance D that is at least 50% longer than distance d. Releasable attachment mechanisms 19 and 18 can connect the liner 8 and first rail 2 to the window covering material 3 as in the first embodiment discussed herein and shown in FIGS. 1-7. For instance, releasable attachment mechanisms 19 can extend along the widths W of the liner 8 and window covering material 3 to releasably connect the liner and window covering material together at spaced apart locations along the entirety of the widths W of the liner 8 and the window covering material 3 at those spaced apart locations. Each attachment mechanisms 19 may be the distance D away from attachment mechanisms that are immediately adjacent to that attachment mechanism 19. In some alternative embodiments, it is contemplated that gaps 31 could be defined along the widths W at the locations in which the releasable attachment mechanism 19 are positioned, but there is not a need for such gaps as the lift cords 6, spacer cords 10, and rings 21 are on a rear side of the liner 8 such that the liner 8 is between the window covering material 3 and the lift cords 6, spacer cords 10, and rings 21 for the embodiment shown in FIG. 8. The difference in distances between distances d and D can define a difference in the number of folds formed in the liner 8 as compared to the number of folds formed in the window covering material 3 such that more folds are formed in the liner 8 than in the window covering material 3. The fewer folds 4 formed in the window covering material 3 can be larger than the folds 4*a* formed in the liner 8 due to the distance D separating immediately adjacent attachment mechanisms 19 being larger than the distance d separating immediately adjacent rings 21 within each column of rings attached to the liner 8.

The first rail 2 may include a lift system 5 coupled to the lift cords 6 for controlling the raising and lowering of the window covering. The configuration of lift cords 6, spacer cords 10, and rings 21 can permit the liner 8 to form folds 4*a* about its front side of the liner facing toward the rear side of the window covering material 3 instead of having it form folds 4*a* on its rear side facing away from the window covering material 3 as in the embodiment of FIGS. 1-7. The window covering material 3 may form folds 4 that are at least 50% larger than the folds 4*a* formed in the liner 8 due to the difference between the spacing of between immediately adjacent attachment mechanisms 19 and the spacing of immediately adjacent rings 21 within the columns or rings attached to the liner and may also cover the folds formed by the liner 8. Motion of the liner 8 between its retracted and extended positions results in the window covering material 3 attached thereto via the spaced apart attachment mechanisms 19 moving as well so that folds 4 are formed when the window covering material 3 retracts and are unformed when the window covering material 3 extends. The folds 4 and 4*a* may be transverse folds that fold along an entirety of the width W of the window covering material 3 and liner 8. The locations at which the folds 4*a* are formed in the liner 8 can be defined by the spacer cords 10, lift cords 6, and location of rings 21. The locations at which the folds 4 are formed in the window covering material 3 can be defined by the locations of the attachment mechanisms 19 used to attach the window covering material 3 to the liner 8. In the embodiment of FIG. 8, the positioning of the rings 21, spacer cords 10 and lift cords 6 can cause the folds 4*a* to face toward the window covering material 3 such that the folds 4 formed in the window covering material 3 may face in the same direction (e.g. the folds 4 that are formed in the window covering of the embodiment shown in FIG. 8 face away from the liner 8 as shown in FIG. 6 and the folds 4*a* face toward the window covering material 3).

Embodiments of the window covering 1 can be configured so that the front window covering material 3 that may face into a room when the window covering is mounted adjacent to a window opening is easily removed from the first rail 2 and liner 8 for removal from the window covering 1. The easy removal of the window covering material 3 can also permit that material to be placed into a washing machine for washing. The stiffening members 13 within the window covering material 3 can also be removable from tabs or pockets to facilitate the washing of the window covering material 3 in a washing machine. While the front room facing window covering material 3 may be removed, the first rail 2 may stay mounted adjacent to a window opening, and the liner 8 can be retained in its position relative to the first rail 2 via attachment to the first rail by lift cords 6 and spacer cords 10.

The easy removal of the window covering material 3 can also permit the window covering material 3 to be replaced with a new window covering material that is of the same structure (e.g. have the same stiffening members 13 and second strips 19*b* of hooks or loops, but may be of a different color or other style to provide a different aesthetic effect. Such a feature permits a customer to only have to replace window covering material 3 to make an interior decoration change to his or her window covering. This can provide less waste as it permits a customer to only have to replace the window covering material 3, and not the whole window covering 1 when making such an interior decoration change. Further, it can provide a less costly alternative to a full window covering replacement as the window covering 1 does not need to be removed so that a new window covering can be mounted and only requires purchase of the window covering material 3, not the full window covering as the first rail 2, liner 8, lift cords 6, and spacer cords 10 can be kept in their mounted position and reused by having the liner 8 and first rail 2 attached to the new window covering material 3 via releasable attachment mechanisms 19 and 18.

It should be understood that embodiments of the window covering may be designed to meet a particular design objective. For example, the window covering material 3 can be composed of fabric material, pleated material, cellular material, interconnected fabric segments, woven wood, woven grass, or bamboo material. The liner 8 can also be composed of fabric material, pleated material, a mesh material, cellular material, interconnected fabric segments, woven wood, woven grass, or bamboo material. As another example, embodiments of the lift system 5 of the window covering may utilize motors, spring motors, loop cord drives or operator cords extending through cord locks in any of a number of different arrangements to control movement of the window covering material 3 and liner 8. As yet another example, the window covering can be configured to include a number of rail elements. For instance, some embodiments of the window covering may only include a headrail. Other embodiments may include a headrail and a bottom rail. The lift cords 6 may be attached to the bottom rail adjacent to the bottom portion 12 of the liner for such embodiments. Yet other embodiments may include a headrail, middle rail, and bottom rail and be configured as a top down bottom up shade. For such embodiments, the first rail may be the middle rail and the window covering material 3 may also be releasably attached to the bottom rail via a releasable attachment mechanism that is structured similarly to attachment mechanism 18 utilized for releasable attachment of window covering material 3 to the first rail 2. The lift cords may extend from the middle rail to the bottom rail for such top down bottom up shade configurations.

As yet another example, embodiments of the window covering may include a valence 9 or may be configured to not include a valence. As yet another example, the number of lift cords and an arrangement of pulleys within a rail for defining a lift cord path for lift cords to move along to actuate adjustment of a position of the window covering can be any arrangement that is able to meet a particular set of design criteria (e.g. desired length of window covering to cover a window opening, desired level of friction inducible when raising and lowering the window covering, etc.). As yet another example, first strips 19*a* can be positioned so that there is one or more first strips 19*a* attached to the liner 8 in a location corresponding to the position of a stiffening member 11 for each and every stiffening member 11 of the liner even though there may be more spaced apart stiffening members 11 in the liner 8 than there are in the window covering material 3. It is contemplated that such a configuration may permit a user to select a particular fold 4 arrangement or adjust that arrangement to a fold formation configuration that the user may desire to be formed by the window covering material 3 when it is raised. For instance, a user could adjust attachment of first strips to second strips 19*a* and 19*b* for such embodiments so that non-uniform sized folds 4 are formed in the window covering material 3 when the window covering is raised (e.g. having some folds 4 of a first size and other folds 4 of a second size that differs from the first size).

While certain exemplary embodiments of the window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail;

a liner attached to the first rail such that the liner is moveable from an extended position to a retracted position;

window covering material attached to at least one of the first rail and the liner such that the window covering material is moveable from an extended position to a retracted position when the liner is moved from the retracted position of the liner to the extended position of the liner, the liner defining an unfolded and unpleated face of material facing away from the window covering material when the window covering material is in the extended position of the window covering material and the liner is in the extended position of the liner;

the window covering material being attached to the liner such that the window covering material forms a first number of folds when the window covering material is moved from the extended position of the window covering material to the retracted position of the window covering material; and the liner being attached to at least one moveable cord extending from the first rail such that the liner forms a second number of folds when the liner is moved from the extended position of the liner to the retracted position of the liner, the second number of folds being a number of folds that is at least 50% larger than the first number of folds;

wherein the window covering material is attached to the first rail via an upper portion of the window covering material that is releaseably attachable to the first rail; and wherein the window covering material is attachable to the liner at vertically spaced apart locations via releasable attachment mechanisms positioned at those vertically spaced apart locations, each of the releasable attachment mechanisms comprising:

at least one strip of hooks attached to one of the window covering material and the liner, and at least one strip of loops attached to the other of the window covering material and the liner.

2. The window covering of claim 1, wherein the second number of folds is a number of folds that is at least twice as many folds as the first number of folds.

3. The window covering of claim 1, comprising:

a plurality of first stiffening members attached to the window covering material at spaced apart locations, a plurality of second stiffening members attached to the liner at spaced apart locations; and wherein the liner is positioned between the window covering material and the at least one cord extending from the first rail to adjacent to a bottom portion of the liner.

4. The window covering of claim 3, wherein each of the first stiffening members is spaced apart from immediately adjacent first stiffening members within the window covering material by a first distance and each of the second stiffening members is spaced apart from immediately adjacent second stiffening members within the liner by a second distance that is shorter than the first distance.

5. The window covering of claim 4, wherein the first distance is twice as long as the second distance or wherein the first distance is at least 50% longer than the second distance and wherein the window covering material is unfolded and unpleated when the window covering material is in the extended position of the window covering material.

6. The window covering of claim 4, comprising a plurality of rings attached to a rear side of the liner, the at least one cord extending from the first rail to adjacent to the bottom portion of the liner passing through the rings or being attached to the rings, a front side of the liner facing toward the window covering material.

7. The window covering of claim 1, wherein the at least one moveable cord is at least one spacer cord, the window covering also comprising:

a first lift cord extending from the first rail to a bottom portion of the liner, the first lift cord being moveable to move the liner from the retracted position of the liner to the extended position of the liner.

8. The window covering of claim 7, further comprising:

a first column of rings that are attached to the liner at spaced apart locations, the first lift cord passing through the rings of the first column of rings, the rings being positioned between the liner and the window covering material.

9. The window covering of claim 8, comprising:

a plurality of first stiffening members attached to the window covering material at spaced apart locations, a plurality of second stiffening members attached to the liner at spaced apart locations, a respective ring of the first column of rings being attached to the liner at a location adjacent to a respective one of the second stiffening members.

10. The window covering of claim 9, wherein each of the first stiffening members is spaced apart from immediately adjacent first stiffening members within the window covering material by a first distance and each of the second stiffening members is spaced apart from immediately adjacent second stiffening members within the liner by a second distance that is shorter than the first distance.

11. The window covering of claim 1, wherein the at least one moveable cord is comprised of a first lift cord, the window covering also comprising:

a cord lock attached to the first rail, at least one operator cord extending from the cord lock to actuate movement of the liner and the window covering material, wherein the window covering material has a hole; and wherein the operator cord extends out of the first rail via the cord lock and extends through the hole in the window covering material.

12. The window covering of claim 11, wherein the first lift cord extends from the first rail to a bottom portion of the liner, the first lift cord being attached to the operator cord.

13. The window covering of claim 12, wherein the operator cord is integral to the first lift cord, the operator cord being a segment of the first lift cord that extends out of the cord lock to extend out of the first rail.

14. The window covering of claim 12, further comprising a spacer cord extending from the first rail, the spacer cord being connected to the liner and the first cord.

15. A window covering, comprising:

a headrail;

a liner attached to the headrail such that the liner is moveable from an extended position in which the liner is unfolded and unpleated, to a retracted position;

window covering material releaseably attached to the headrail, the window covering material also being releaseably attachable to the liner at vertically spaced apart locations such that the window covering material is moveable from a retracted position to an extended position when the liner is moved from the retracted position of the liner to the extended position of the liner;

a lift system attached to the headrail;

at least one lift cord extending from the lift system to a bottom portion of the liner, movement of the lift cord driving movement of the liner between the extended position of the liner and the retracted position of the liner;

the window covering material being releaseably attached to the liner such that the window covering material forms a first number of folds when the window covering material is moved from the extended position of the window covering material to the retracted position of the window covering material; and the liner being attached to each lift cord such that the liner forms a second number of folds when the liner is moved from the extended position of the liner to the retracted position of the liner, the second number of folds being a number of folds that is at least 50% larger than the first number of folds, movement of the liner from the extended position of the liner to the retracted position of the liner causing movement of the window covering material between the extended position of the window covering material to the retracted position of the window covering material.

16. The window covering of claim 15, wherein the window covering material is releaseably attachable to the liner at vertically spaced apart locations via attachment mechanisms that extend along a substantial portion of a width of the liner and a width of the window covering material at those spaced apart locations, each of the attachment mechanisms comprising:

at least one strip of hooks attached to one of the window covering material and the liner, and at least one strip of loops attached to the other of the window covering material and the liner.

17. The window covering of claim 16, wherein the at least one lift cord is comprised of a first lift cord and a second lift cord; and wherein each of the attachment mechanisms is configured to define at least a first gap and a second gap along the widths of the liner and the window covering material at the vertically spaced apart locations, the first lift cord passing through each first gap and the second lift cord passing through each second gap.

18. The window covering of claim 16, wherein the at least one lift cord is comprised of a first lift cord and a second lift cord; and the window covering material has a hole defined therein and the window covering comprises at least one operator cord attached to the first and second lift cords, the operator cord extending from the headrail passing through the hole of the window covering material for manipulation of the operator cord to actuate the lift system.

19. The window covering of claim 16, comprising:

a plurality of first stiffening members attached to the window covering material at spaced apart locations, a plurality of second stiffening members attached to the liner at spaced apart locations;

wherein each of the attachment mechanisms is attached to the window covering material adjacent to a respective one of the first stiffening members to releaseably attach the window covering material to the liner at spaced apart locations; and wherein each of the first stiffening members is spaced apart from immediately adjacent first stiffening members within the window covering material by a first distance and each of the second stiffening members is spaced apart from immediately adjacent second stiffening members within the liner by a second distance.

20. The window covering of claim 16 wherein the liner is positioned between the window covering material and a segment of the at least one lift cord that extends from the headrail to the bottom portion of the liner.

* * * * *